US010955210B1

(12) United States Patent
Roberts

(10) Patent No.: US 10,955,210 B1
(45) Date of Patent: Mar. 23, 2021

(54) FIREARM APPARATUS

(71) Applicant: Evan Ray Roberts, Burnaby (CA)

(72) Inventor: Evan Ray Roberts, Burnaby (CA)

( * ) Notice: Subject to any disclaimer, the term of this patent is extended or adjusted under 35 U.S.C. 154(b) by 0 days.

(21) Appl. No.: 16/836,731

(22) Filed: Mar. 31, 2020

(51) Int. Cl.
*F41A 17/34* (2006.01)

(52) U.S. Cl.
CPC ..... *F41A 17/34* (2013.01)

(58) Field of Classification Search
CPC ..... F41A 17/36; F41A 17/38; F41A 17/40; F41A 9/65
USPC ..... 42/70, 17, 18, 19
See application file for complete search history.

(56) References Cited

U.S. PATENT DOCUMENTS 3,383,790 A * 5/1968 Into ..... F41A 9/65 42/50
4,664,015 A * 5/1987 Kennedy ..... F41A 9/59 89/138
8,572,875 B2 * 11/2013 Sisgold ..... F41A 17/36 42/1.02
10,228,201 B2 * 3/2019 Walther ..... F41A 3/68
2010/0101132 A1 * 4/2010 Jacobson ..... F41A 9/65 42/50
2013/0014416 A1 * 1/2013 Sisgold ..... F41A 9/66 42/1.02
2015/0198404 A1 * 7/2015 Campbell ..... F41A 33/00 42/70.11
2017/0146310 A1 * 5/2017 Biran ..... F41C 3/00
2017/0160026 A1 * 6/2017 Walther ..... F41A 3/68
2018/0149438 A1 * 5/2018 Headrick ..... F41A 9/65
2018/0313619 A1 * 11/2018 Iwasawa ..... F41A 17/36
2020/0240728 A1 * 7/2020 Brooksby ..... F41A 17/06
2020/0248977 A1 * 8/2020 Maldonado ..... F41A 3/66
2020/0263944 A1 * 8/2020 Harris ..... F41A 17/36
2020/0278164 A1 * 9/2020 Denson, III ..... F41A 17/40

* cited by examiner

*Primary Examiner* — Joshua E Freeman
(74) *Attorney, Agent, or Firm* — Orin Del Vecchio

(57) ABSTRACT

A firearm apparatus that is operable to provide faster reloading of an ammunition magazine through operable engagement of the trigger, the hammer or the bolt carrier. The firearm apparatus of the present invention includes a magazine that is configured to receive and store a plurality of bullets within the interior volume thereof on an ammunition support member. The ammunition support member is movable intermediate a first and second position and in the second position, an engagement member operably coupled to the ammunition support member is operable to engage the arm member. The arm member is moved to its second position wherein the arm member in its second position inhibits the firing of the firearm and maintains the bolt in a closed position. The arm member can be provided in alternative embodiments so as to operably coupled with the aforementioned elements of the firing assembly.

9 Claims, 2 Drawing Sheets

FIREARM APPARATUS

FIELD OF THE INVENTION

The present invention relates generally to firearm apparatus, more specifically but not by way of limitation, a firearm apparatus configured to be operably integrated with a semi-automatic, fully automatic or burst mode configured firearms that is operable to provide improved efficiency during re-loading of a subsequent magazine through inhibiting expensing of the final ammunition cartridge in an ammunition magazine and maintaining the bolt carrier, hammer or trigger in a position that promotes faster reloading of an ammunition magazine.

BACKGROUND

Millions of individuals regularly utilize firearms. There are two general types of firearms, long guns and handguns. For both of the aforementioned types there can be various types of firing actions. Some long guns are configured as single action bolt mechanisms wherein the long gun is configured to fire one round of ammunition and then the user must manually engage the bolt carrier to reload a round of ammunition. Many conventional handguns are configured as revolvers wherein the handgun utilizing a cylindrical mechanism that is rotatably moved to provide a subsequent round of ammunition for the hammer/firing pin. Both long guns and handguns are provided in semi-automatic and fully automatic configurations. As is known in the art semi-automatic and fully automatic weapons utilize a carrier bolt that can be driven by gas or mechanical elements wherein the carrier bolt is cycled in a rearward-forward direction so as to expel a spent ammunition cartridge and load a new ammunition cartridge from a magazine. The magazines are typically vertical in configuration and are mounted underneath the firing chamber.

As round of ammunition is fired, the carrier assembly will move in a rearwards direction and expel the spent cartridge. The magazine has a spring underneath a plurality of ammunition cartridges and the spring will exert an upward force that is operable to move the next round of ammunition cartridge into the firing chamber with this action being completed by the carrier assembly moving forward. When a user has fired all of the ammunition in a magazine, the carrier assembly will typically remain in the rear position. The user must then remove the magazine and load another magazine and reset the carrier to a forward position and with some gun models cycle the bolt carrier to load a round of ammunition into the firing chamber. The aforementioned can take time and during certain firearm activities this can be undesirable.

It is intended within the scope of the present invention to provide a firearm apparatus that is operably integrated with a firearm wherein the firearm apparatus of the present invention is operable to detect the last round of ammunition in a magazine and inhibit the firing thereof so as to facilitate the faster reloading of a subsequent magazine.

SUMMARY OF THE INVENTION

It is the object of the present invention to provide a firearm apparatus configured to be operably integrated with a firearm wherein the present invention is operably integrated with a firearm and is configured to inhibit the firing of the last round of ammunition in a magazine.

Another object of the present invention is to provide a firearm apparatus that is configured to improve the reloading time for a user wherein the present invention includes an element to engage the bolt carrier or hammer of a firearm.

A further object of the present invention is to provide a firearm apparatus configured to be operably integrated with a firearm wherein the element configured to engage the hammer or bolt carrier is integrated with the ammunition magazine.

Still another object of the present invention is to provide a firearm apparatus that is configured to improve the reloading time for a user wherein the present invention is configured to include an element that will operably engage the hammer or bolt carrier so as to lock the position thereof when the magazine has the last round of ammunition therein.

An additional object of the present invention is to provide a firearm apparatus configured to be operably integrated with a firearm wherein the present invention includes an element in an alternative embodiment thereof that is operable to engage the trigger mechanism of the firearm.

Yet a further object of the present invention is to provide a firearm apparatus that is configured to improve the reloading time for a user wherein the empty magazine and an element thereof operably couples with a portion of the trigger so as to provide disengagement thereof.

Another object of the present invention is to a provide a firearm apparatus configured to be operably integrated with a firearm wherein the present invention is operable to provide re-engagement of the trigger subsequent release of the empty magazine.

An alternate object of the present invention is to provide a firearm apparatus that is configured to improve the reloading time for a user wherein an arm member of the present invention directionally traverses so as to place the trigger, bolt carrier or hammer into a disabled position.

Still a further object of the present invention is to provide a firearm apparatus configured to be operably integrated with a firearm wherein a hammer engagement element is present in an embodiment of the present invention wherein the hammer engagement element is operable to lock the hammer when the ammunition magazine becomes empty or has one round of ammunition therein.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
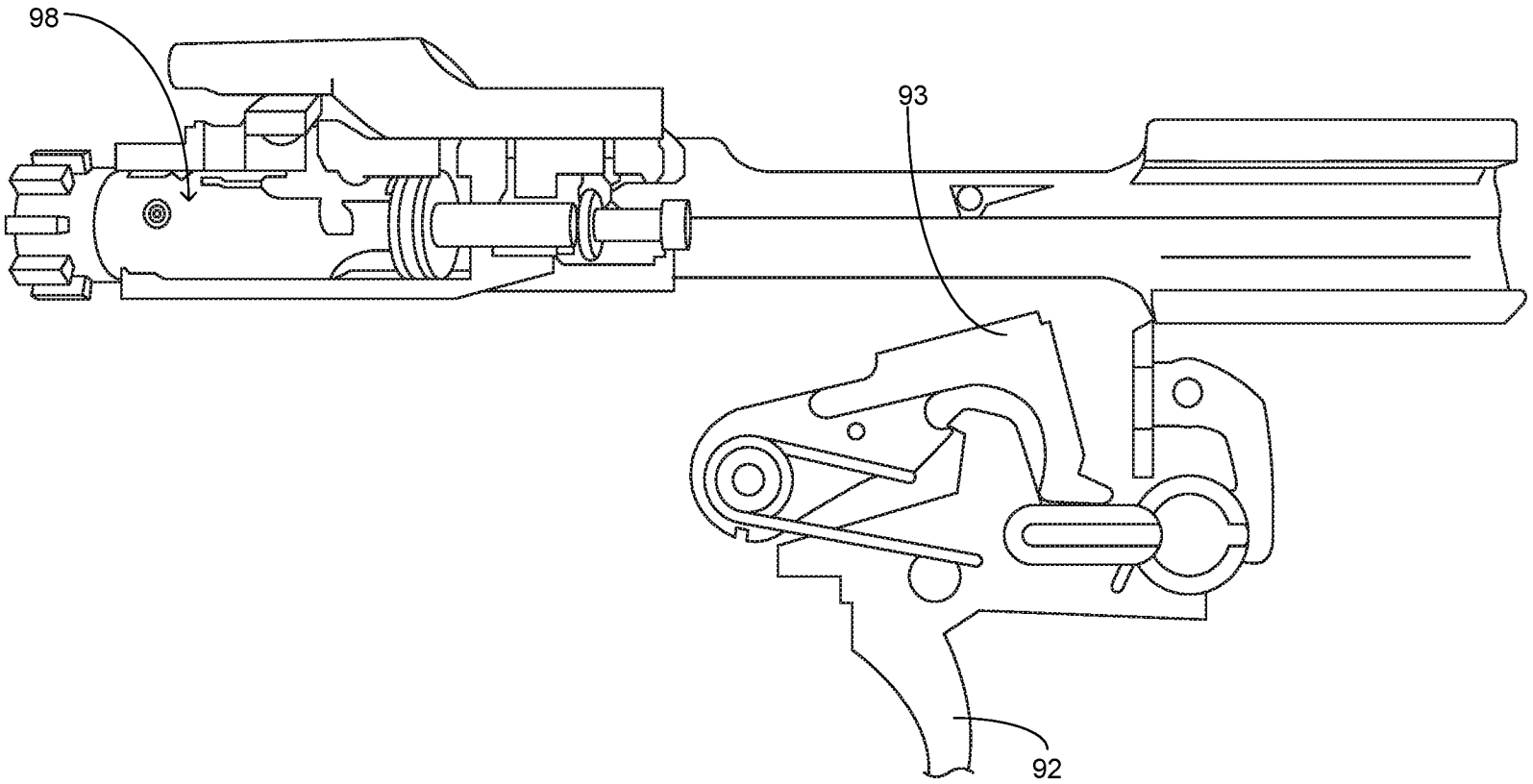
FIG. 1 is a diagrammatic view of an embodiment of the present invention.
Figure 2:
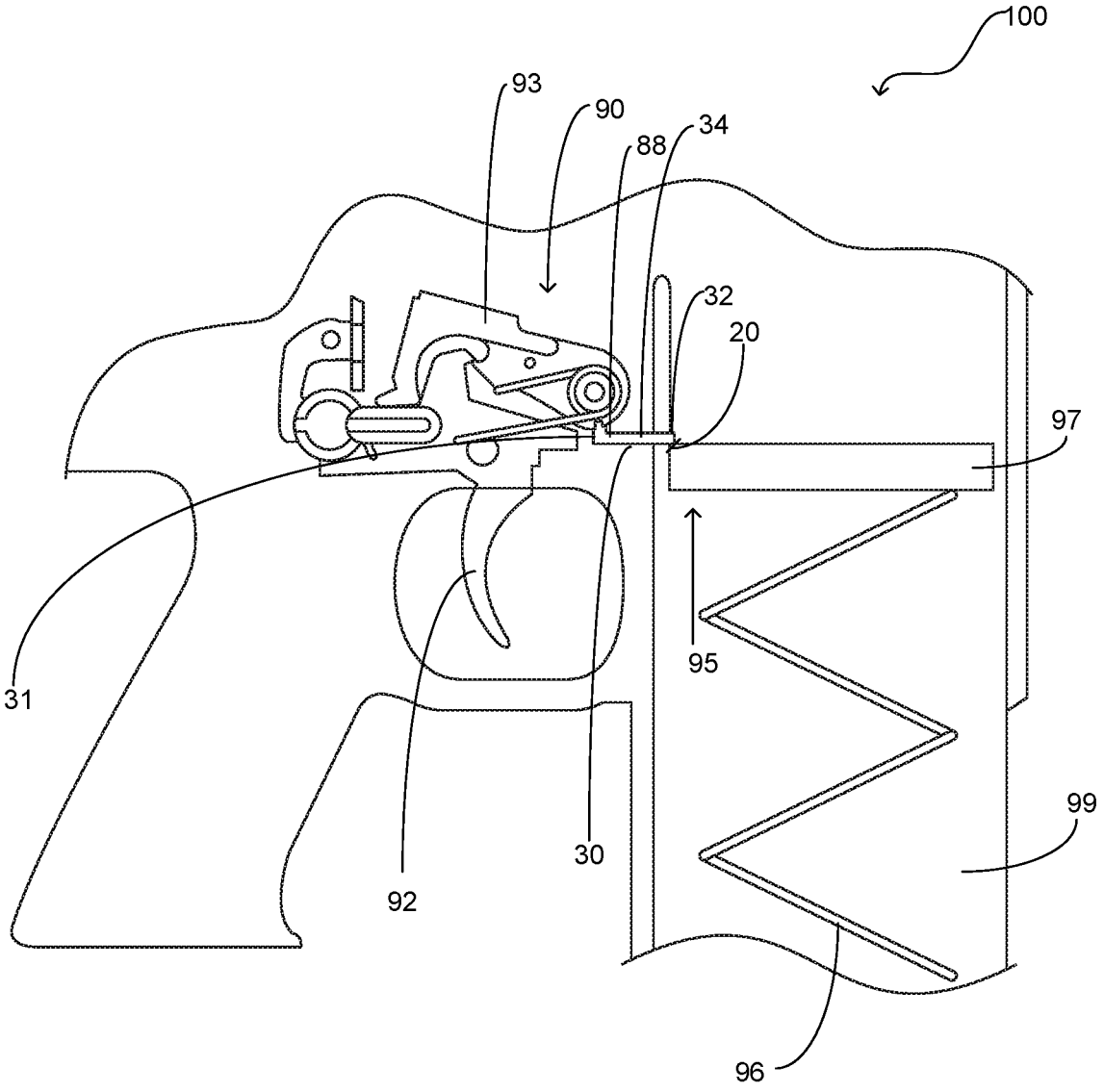
FIG. 2 is an exemplary diagram of a firearm bolt carrier and trigger/hammer assembly.

Referring now to the drawings submitted herewith, wherein various elements depicted therein are not necessarily drawn to scale and wherein through the views and figures like elements are referenced with identical reference numerals, there is illustrated a firearm apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the drawing submitted herewith, the firearm apparatus 100 is operable to provide faster reloading of an exemplary ammunition magazine 99. The firearm apparatus 100 in a preferred embodiment is operably coupled to ammunition magazine 99. As is known in the art, a semi-automatic, fully automatic or burst mode configured firearms are repetitively fired, the bolt carrier 98 cycles in a rearwards-forwards motion and is operable to facilitate the ejection of a spent casing in the rearward direction and assist in loading of an ammunition round into a firing chamber in the forward direction. During the firing process, the bullet support member 97 disposed within the ammunition magazine moves in an upward direction as the rounds of ammunition (not illustrated herein) are removed therefrom one by one into the firing chamber, fired and subsequently expelled. The bullet support member 97 is moved upward by the biasing member 96 which is typically a spring that is compressed during loading of rounds of ammunition into the magazine 99 and applies a biasing force upwards thereto in order to facilitate the desired movement of the bullets into the firing chamber.

The firearm apparatus 100 is operably coupled to the magazine 99 and at least one of the following firearm components: trigger, bolt carrier or hammer, in order to place the firearm in a position wherein the magazine can be released and replaced with a loaded magazine with minimal movements of the bolt carrier 98. As is known in the art, once a magazine 99 has been depleted of ammunition, the bolt carrier 98 will remain in an open position with the firing chamber empty. The process of then reloading a loaded magazine and placing the firearm in ready to fire condition can take more time than desired in certain tactical firearm application. The firearm apparatus 100 includes an engagement member 20. The engagement member 20 is operably coupled to the bullet support member 97, specifically the end 95 thereof proximate the firing assembly 90. The engagement member 20 is manufactured from a suitable durable material such as but not limited to metal. The engagement member 20 is manufactured so as to not interfere with the normal traversing of the bullet support member 97 nor interrupt the bullet configuration superposed thereon. It should be understood within the scope of the present invention that the engagement member 20 could be manufactured in various shapes and sizes and achieve the desired objective herein.

The engagement member 20 is operable to engage arm member 30. The arm member 30 includes a first portion 32 and a second portion 34. Arm member 30 is movably coupled to the ammunition magazine 99 utilizing suitable durable techniques. The first portion 32 is disposed within the ammunition magazine 99 and is configured to operably engage the engagement member 20. The second portion 34 of the arm member 30 is positioned adjacent the exterior of the magazine 99. The second portion 34 is configured to operably engage either the trigger 92, hammer 93 or bolt carrier 98 in order to place a firearm in a position that requires the minimal amount of mechanical movements during reloading of an ammunition magazine 99 as previously discussed herein. The arm member 30 is operable to be moved so as to engage either the trigger 92, hammer 93 or bolt carrier 98 subsequent being operably contacted by the engagement member 20. While an engagement member 20 and arm member 30 are illustrated and discussed herein, it is contemplated within the scope of the present invention that the various alternative embodiments thereof could be employed so as to accomplish inhibiting firing of a final round of ammunition disposed in the ammunition magazine 99. The aforementioned could employ means that are disposed within or exterior to the ammunition magazine 99 wherein the means function to engage either the trigger 92, hammer 93 or bolt carrier 98.

In an embodiment illustrated herein, the arm member 30 is shown for exemplary purposes being configured to engage the hammer 93. Ensuing operable contact between the engagement member 20 and the first portion 32 of the arm member 30, the arm member 30 moves so as to engage notch 88 of the hammer 93. Engagement of the notch 88 by the end 31 of the arm member locks the hammer 93 so as to inhibit movement thereof. In a preferred embodiment of the invention, this will occur so as to inhibit the bolt carrier 98 from being left in an open position while waiting for a re-loading procedure to be commenced by an operator of a firearm. Once the arm member 30 places the hammer 93 in a locked position, the user of a firearm ejects the magazine 99 and replaces with a magazine 99 of the same configuration having rounds of ammunition disposed therein. During removal of the first magazine, the hammer 93 is moved to an unlocked position due to arm member 30 becoming disengaged therewith. This enables a user to immediately begin firing the firearm without requirement of any additional mechanical movement as one round of ammunition was left in the firing chamber.

While an embodiment is illustrated herein demonstrating engagement of the hammer 93, it is contemplated within the scope of the present invention that the arm member 30 could be alternatively configured to operably engage the trigger 92 or bolt carrier 98 so as to provide the identical aforementioned functionality of ensuring a faster reloading of an ammunition magazine. It should be understood within the scope of the present invention that additional elements could be provided in conjunction with or in place of the arm member 30 to ensure desired operable engagement with the trigger 92 or bolt carrier 98.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A firearm apparatus for a firearm that is operable to provide faster reloading of an ammunition magazine wherein the firearm apparatus comprises:

an ammunition magazine, said ammunition magazine having an interior volume configured to receive and store a plurality of rounds of ammunition;

an ammunition support member, said ammunition support member being movably disposed within the interior volume of said ammunition magazine, said ammunition support member having a first end and a second end, said ammunition support member configured to have rounds of ammunition superposed thereon;

an engagement means, said engagement means being operably coupled to said first end of said ammunition support member, said engagement means configured to operably couple with a component of a firing assembly of the firearm so as to inhibit firing of the firearm during presence of a single round of ammunition remaining in the interior volume of the ammunition magazine.

2. The firearm apparatus as recited in claim 1, wherein firing assembly is selected from a group consisting of: a trigger, a hammer or a bolt carrier.

3. The firearm apparatus as recited in claim 2, wherein engagement means further includes an arm member, said arm member having first portion and a second portion, wherein the first portion is disposed within the interior volume of the magazine.

4. The firearm apparatus as recited in claim 3, wherein the arm member has a first position and a second position.

5. The firearm apparatus as recited in claim 4, wherein in said second position said arm member is operable to inhibit firing of the firearm.

6. The firearm apparatus as recited in claim 5, wherein said arm member is moved to said second position ensuing a final round of ammunition being present in said ammunition magazine.

7. A firearm apparatus for a firearm that is operable to provide more efficient reloading of an ammunition magazine by preventing an open bolt wherein the firearm apparatus comprises:

an ammunition magazine, said ammunition magazine having an interior volume configured to receive and store a plurality of rounds of ammunition, said ammunition magazine being releasably secured to the firearm;

an ammunition support member, said ammunition support member being movably disposed within the interior volume of said ammunition magazine, said ammunition support member having a first end and a second end, said ammunition magazine having a bottom end and a top end, said ammunition support member configured to have a first position and a second position wherein in said second position said ammunition support member is proximate said top end of said magazine, said ammunition support member configured to have rounds of ammunition superposed thereon;

an arm member, said arm member configured to be operably coupled intermediate said magazine and a portion of a firing assembly of the firearm, said arm member having a first portion and a second portion;

an engagement member, said engagement member being operably coupled to said first end of said ammunition support member, said engagement member configured to operably couple with said arm member when said ammunition support member is in said second position.

8. The firearm apparatus as recited in claim 7, wherein said arm member is configured to operably engage at least one firearm element selected from a group consisting of: a trigger, a hammer or a bolt carrier.

9. The firearm apparatus as recited in claim 8, wherein in said second position said arm member is operable to inhibit firing of the firearm.

* * * * *